US010266376B2

(12) United States Patent
Hall, Jr.

(10) Patent No.: US 10,266,376 B2
(45) Date of Patent: Apr. 23, 2019

(54) LIFTING METHOD AND APPARATUS

(71) Applicant: The Boeing Company, Chicago, IL (US)

(72) Inventor: Curtis L. Hall, Jr., Moncks Corner, SC (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/713,654

(22) Filed: Sep. 24, 2017

(65) Prior Publication Data

US 2019/0092604 A1 Mar. 28, 2019

(51) Int. Cl.
*B66C 1/16* (2006.01)

(52) U.S. Cl.
CPC ..... *B66C 1/16* (2013.01)

(58) Field of Classification Search
CPC ..... B66C 1/16; B66C 1/18
See application file for complete search history.

(56) References Cited

U.S. PATENT DOCUMENTS 762,875 A * 6/1904 Blodgett
1,027,907 A * 5/1912 Sannnnon ..... B65D 19/38 187/411
1,401,206 A * 12/1921 Swartz ..... B66C 1/16 294/67.41
1,834,902 A * 12/1931 Payzant ..... B66C 1/16 294/67.4
2,235,719 A * 3/1941 Matarese ..... B66C 1/16 294/67.41
3,945,674 A * 3/1976 Ide ..... B66C 1/10 294/67.1
4,384,817 A 5/1983 Peterson
5,829,948 A 11/1998 Becklund
5,863,085 A * 1/1999 Khachaturian ..... B66C 1/12 294/81.1
5,897,104 A 4/1999 Garbiso
6,071,062 A 6/2000 Warhurst et al.
6,079,925 A 6/2000 Morgan et al.
6,213,319 B1 4/2001 Khachaturian
7,290,815 B1 * 11/2007 Whittington ..... B66C 1/14 294/67.4

FOREIGN PATENT DOCUMENTS

CA 02900438 A1 * 2/2016
GB 445204 A * 4/1936

* cited by examiner

*Primary Examiner* — Stephen A Vu
(74) *Attorney, Agent, or Firm* — Yee & Associates, P.C.

(57) ABSTRACT

A lifting apparatus and method. The lifting apparatus comprising a lower bar assembly, an upper frame assembly, and a plurality of straps. The lower bar assembly comprises a first bar and a second bar. The upper frame assembly comprises a first upper frame bar, a second upper frame bar substantially parallel to the first upper frame bar, and a cross piece connecting the first upper frame bar to the second upper frame bar and substantially perpendicular to the first upper frame bar and the second upper frame bar. The plurality of straps are fixedly attached to the lower bar assembly and slidably attached to the upper frame assembly.

19 Claims, 6 Drawing Sheets

400
402
404
405
406
408

LIFTING METHOD AND APPARATUS

BACKGROUND INFORMATION

1. Field

The present disclosure relates generally to systems and methods for lifting and moving objects. More particularly, the present disclosure relates to a system and method for lifting relatively large, heavy, and irregularly shaped objects, such as internal components for an aircraft.

2. Background

Various aircraft components may be relatively big, heavy, and awkward to move. For example, without limitation, such components may include an aircraft closet, a crew rest, or other components for the interior or exterior of an aircraft. Such components may weigh in excess of several hundred pounds.

Currently, it may require three or more human operators to lift and move large aircraft components. Such components may be odd shaped and awkward to carry. Therefore, extra caution must be used to prevent injuries when such components are lifted and moved manually.

Various machines may be used to lift large and heavy objects. A fork-lift is an example of one such machine that may be used to lift and move such objects. However, care must be taken to secure the object to be lifted to the machine so that the object does not fall from the machine while being lifted or moved. Securing an object to a machine for lifting and movement by tying the object to the machine using ropes or other devices in a conventional manner may be time-consuming. Securing especially large and irregular objects to a machine for movement requires particular skill and may be particularly time-consuming.

Therefore, there may be a need for a method and apparatus that take into account at least some of the issues discussed above, as well as other possible issues.

SUMMARY

In one illustrative embodiment, a lifting apparatus comprises a lower bar assembly, an upper frame assembly, and a plurality of straps. The plurality of straps are fixedly attached to the lower bar assembly and slidably attached to the upper frame assembly.

In another illustrative embodiment, a lifting apparatus comprises a lower bar assembly, an upper frame assembly, and a plurality of straps. The lower bar assembly comprises a first lower bar and a second lower bar. The upper frame assembly comprises a first upper frame bar, a second upper frame bar substantially parallel to the first upper frame bar, and a cross piece connecting the first upper frame bar to the second upper frame bar and substantially perpendicular to the first upper frame bar and the second upper frame bar. The plurality of straps are fixedly attached to the lower bar assembly and slidably attached to the upper frame assembly.

In yet another illustrative embodiment, a method of lifting a payload comprises placing a lower bar assembly under the payload. An upper frame assembly is placed over the payload. A plurality of straps are slidably attached to the upper frame assembly. The plurality of straps are fixedly attaching to the lower bar assembly. The payload is lifted by pulling upward on the straps to hold the payload between the lower bar assembly and the upper frame assembly while the payload is being lifted.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives, and features thereof, will best be understood by reference to the following detailed description of one or more illustrative embodiments of the present disclosure when read in conjunction with the accompanying drawings, wherein:

DETAILED DESCRIPTION

The illustrative embodiments recognize and take into account different considerations. For example, the illustrative embodiments provide for safely lifting large, awkward components by a single operator. The apparatus comprises an upper frame, a pair of lower beams, and a plurality of straps fixed to the lower beams and slidably coupled to the upper frame. A payload is held between the lower beams and the upper frame when the straps are pulled upward to lift the payload.

Figure 1:
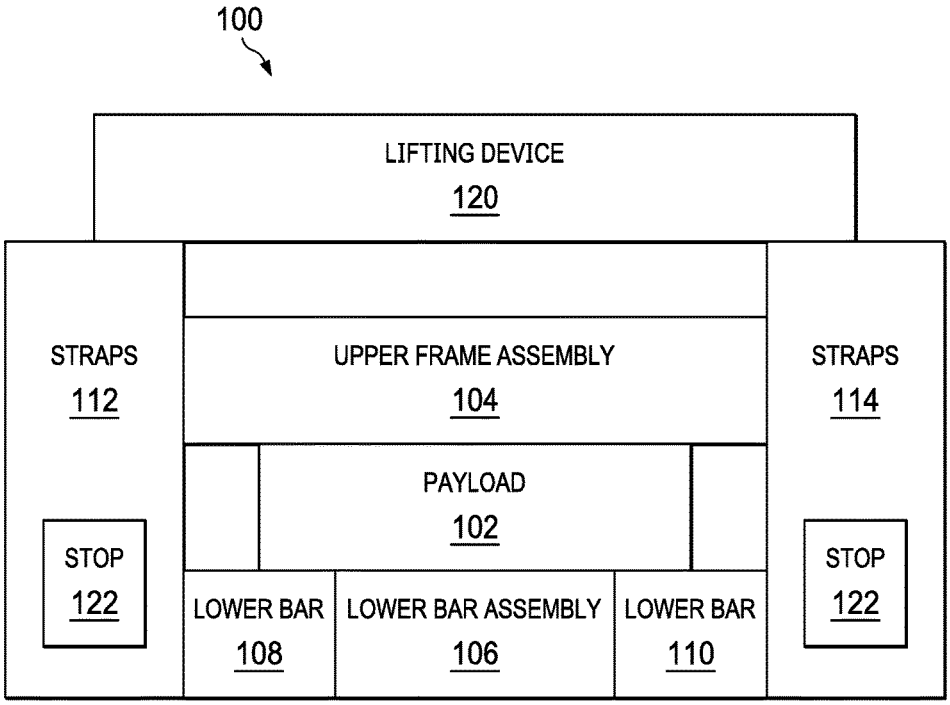
FIG. 1 is an illustration of a block diagram of a lifting apparatus in accordance with an illustrative embodiment.

Turning to FIG. 1, an illustration of a block diagram of a lifting apparatus is depicted in accordance with an illustrative embodiment. Lifting apparatus 100 may be configured to lift and move payload 102. Payload 102 may comprise any appropriate object of any appropriate size and shape. For example, without limitation, payload 102 may comprise a component for an aircraft, such as an aircraft closet, a crew rest, or other components for the interior or exterior of an aircraft.

In accordance with an illustrative embodiment, lifting apparatus 100 comprises upper frame assembly 104 and lower bar assembly 106. Lower bar assembly 106 comprises lower bar 108 and lower bar 110. Lower bar 108 may be referred to as a first lower bar. Lower bar 110 may be referred to as a second lower bar.

Straps 112 may be fixedly attached to lower bar 108 in lower bar assembly 106 and slidably attached to upper frame assembly 104. Straps 114 may be fixedly attached to lower bar 110 in lower bar assembly 106 and slidably attached to upper frame assembly 104.

Upper ends of straps 112 and straps 114 may be attached to lifting device 120. Lifting device 120 may comprise any appropriate device or system for lifting upward on straps 112 and straps 114. For example, without limitation, lifting device 120 may comprise a crane or other appropriate device or system.

In operation, payload 102 is positioned between lower bar assembly 106 and upper frame assembly 104. By pulling upward on straps 112 and straps 114 by lifting device 120, upper frame assembly 104 is forced downward against payload 102 to secure payload 102 in lifting apparatus 100 as payload 102 is moved by lifting apparatus 100.

Stop 122 may be provided on each of straps 112 and straps 114. Stop 122 may comprise any structure attached to straps 112 and straps 114 to prevent straps 112 and straps 114 from sliding through upper frame assembly 104 so as to become separated from upper frame assembly 104. For example, without limitation, upper frame assembly 104 may be lifted and moved by lifting device 120 without lower bar assembly 106 and payload 102 by disconnecting straps 112 and straps 114 from lower bar assembly 106 and lifting upward on straps 112 and straps 114 until stop 122 engages upper frame assembly 104.

The illustration of lifting apparatus 100 in FIG. 1 is not meant to imply physical or architectural limitations to the manner in which illustrative embodiments may be implemented. Other components, in addition to or in place of the ones illustrated, may be used. Some components may be optional. Also, the blocks are presented to illustrate some functional components. One or more of these blocks may be combined, divided, or combined and divided into different blocks when implemented in an illustrative embodiment.

Figure 2:
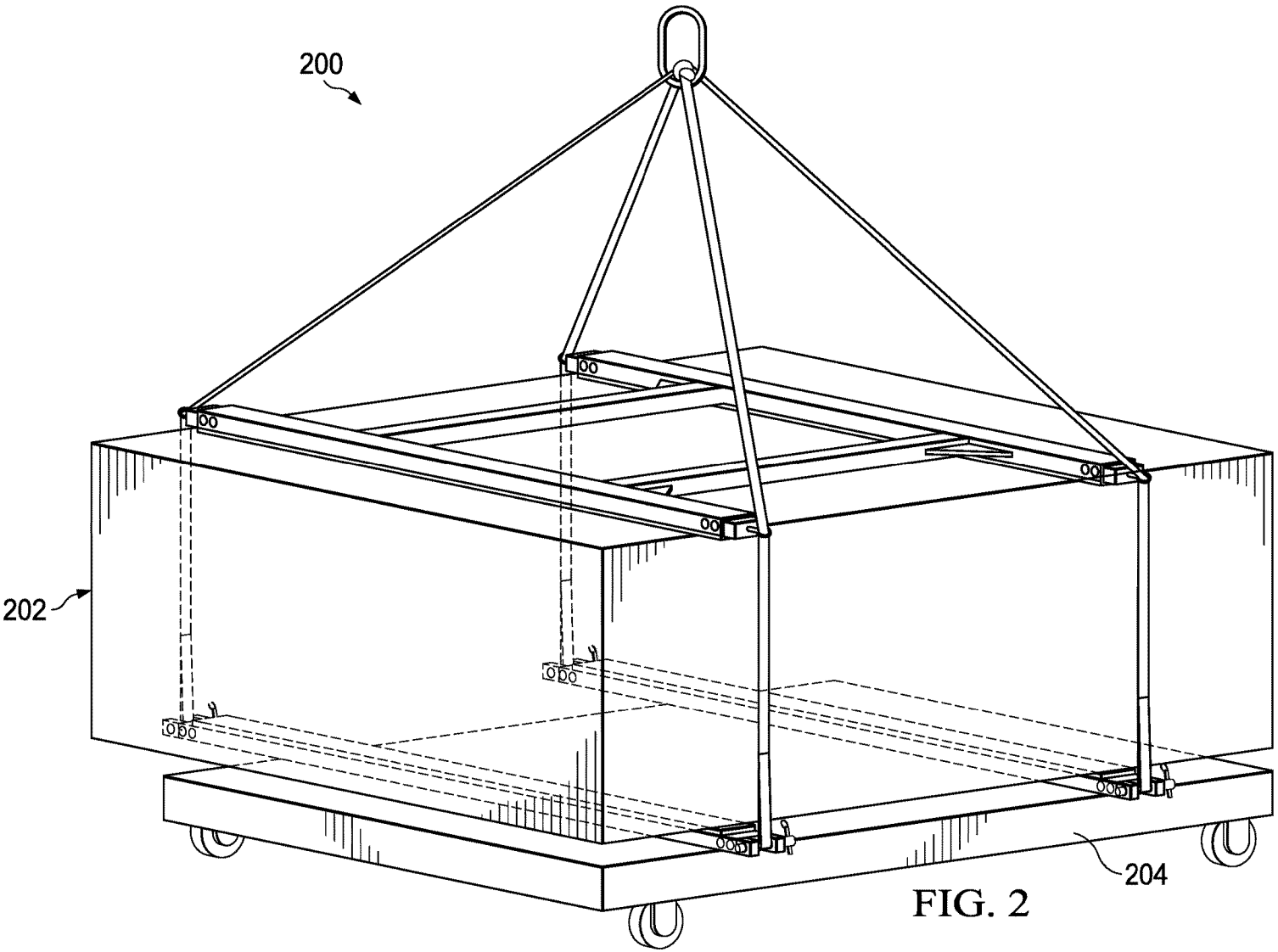
FIG. 2 is an illustration of a perspective view of a lifting apparatus and a payload in accordance with an illustrative embodiment.

Turning to FIG. 2, an illustration of a perspective view of a lifting apparatus and a payload is depicted in accordance with an illustrative embodiment. Lifting apparatus 200 may be an example of one implementation of lifting apparatus 100 shown in block form in FIG. 1. In this example, lifting apparatus 200 is shown lifting payload 202 onto or off of transportation device 204. For example, without limitation, transportation device 204 may be any appropriate device that is configured for moving payload 202 in an assembly area or any other appropriate environment.

Figure 3:
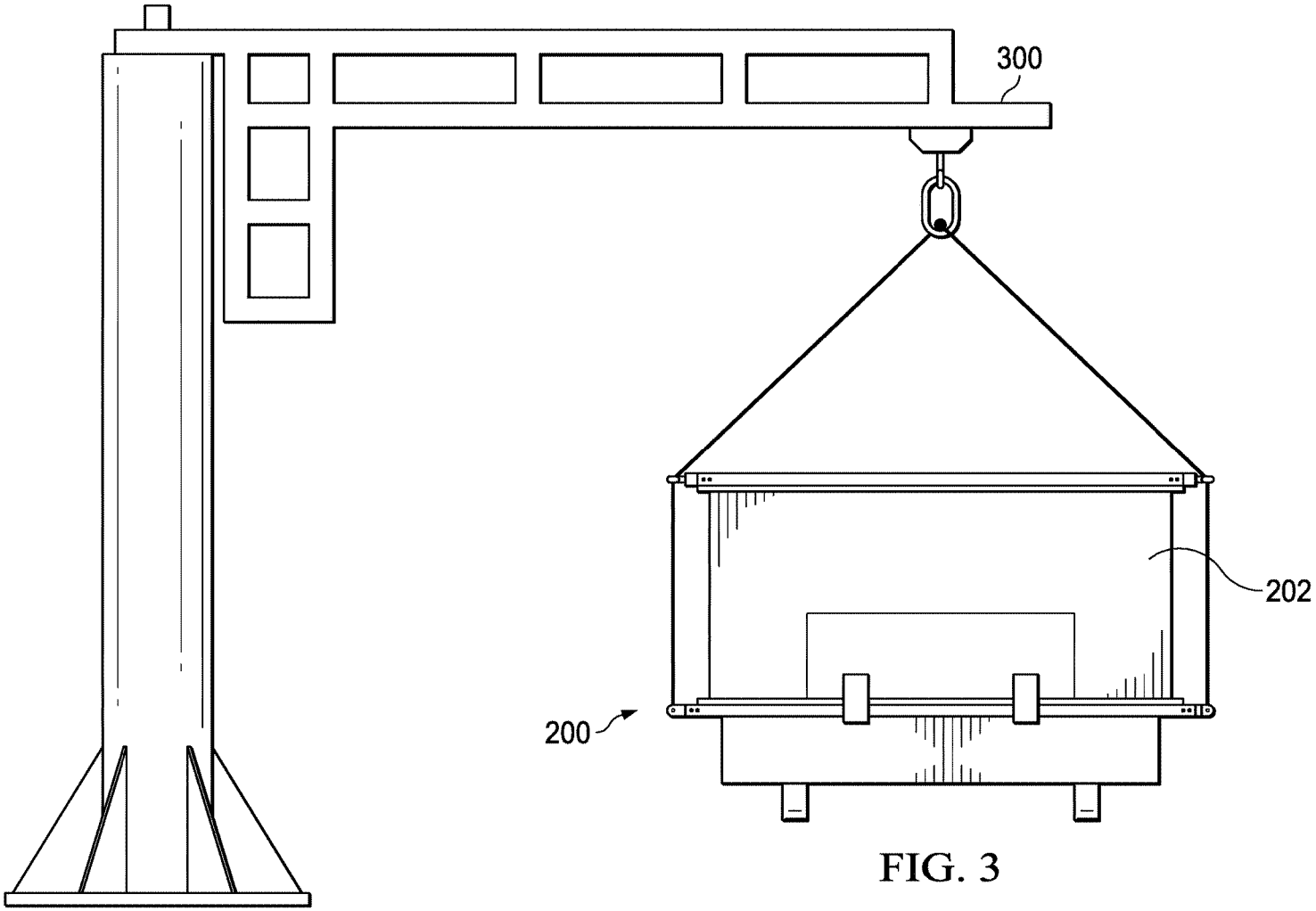
FIG. 3 is an illustration of a side view of a lifting apparatus and a payload being lifted by a lifting device in accordance with an illustrative embodiment.

Turning to FIG. 3, an illustration of a side view of a lifting apparatus and a payload being lifted by a lifting device is depicted in accordance with an illustrative embodiment. In this example, lifting apparatus 200 is shown attached to crane 300. Crane 300 may be an example of one implementation of lifting device 120 shown in block form in FIG. 1.

Figures 4, 5:
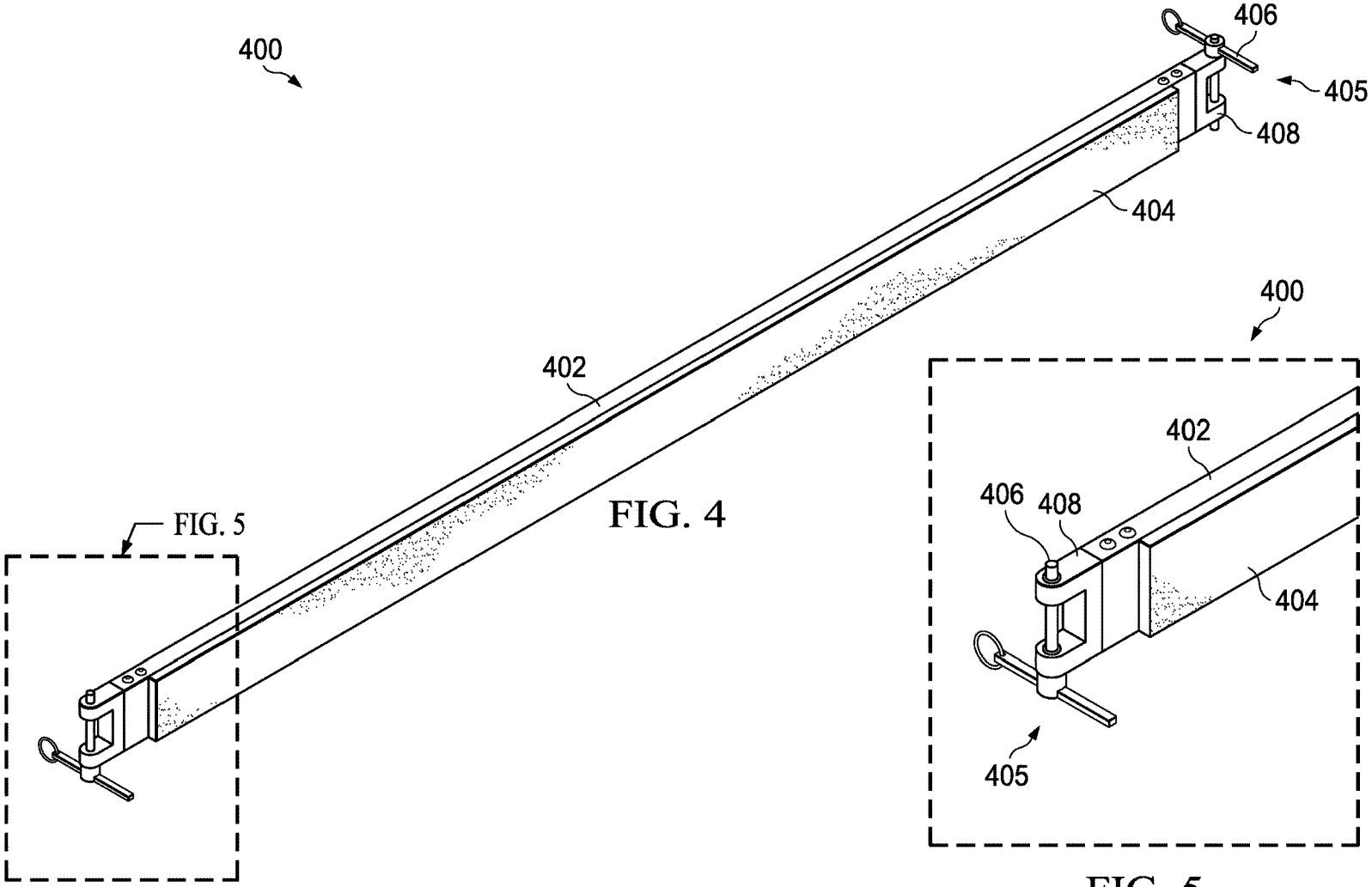
FIG. 4 is an illustration of a perspective view of a lower bar for a lifting apparatus in accordance with an illustrative embodiment.
FIG. 5 is an illustration of a perspective view in detail of one end of the lower bar illustrated in FIG. 4 in accordance with an illustrative embodiment.

Turning to FIG. 4, an illustration of a perspective view of a lower bar for a lifting apparatus is depicted in accordance with an illustrative embodiment. Lower bar 400 may be an example of one implementation of lower bar 108 or lower bar 110 in FIG. 1.

Lower bar 400 may comprise bar structure 402, padding 404, and attachment structure 405 for fixedly attaching lower bar 400 to straps, such as straps 112 or straps 114 shown in block form in FIG. 1. For example, without limitation, attachment structure 405 may comprise pin 406 which is configured to be inserted and held in clevis 408.

Turning to FIG. 5, an illustration of a perspective view in detail of one end of the lower bar illustrated in FIG. 4 is depicted in accordance with an illustrative embodiment.

Figure 6:
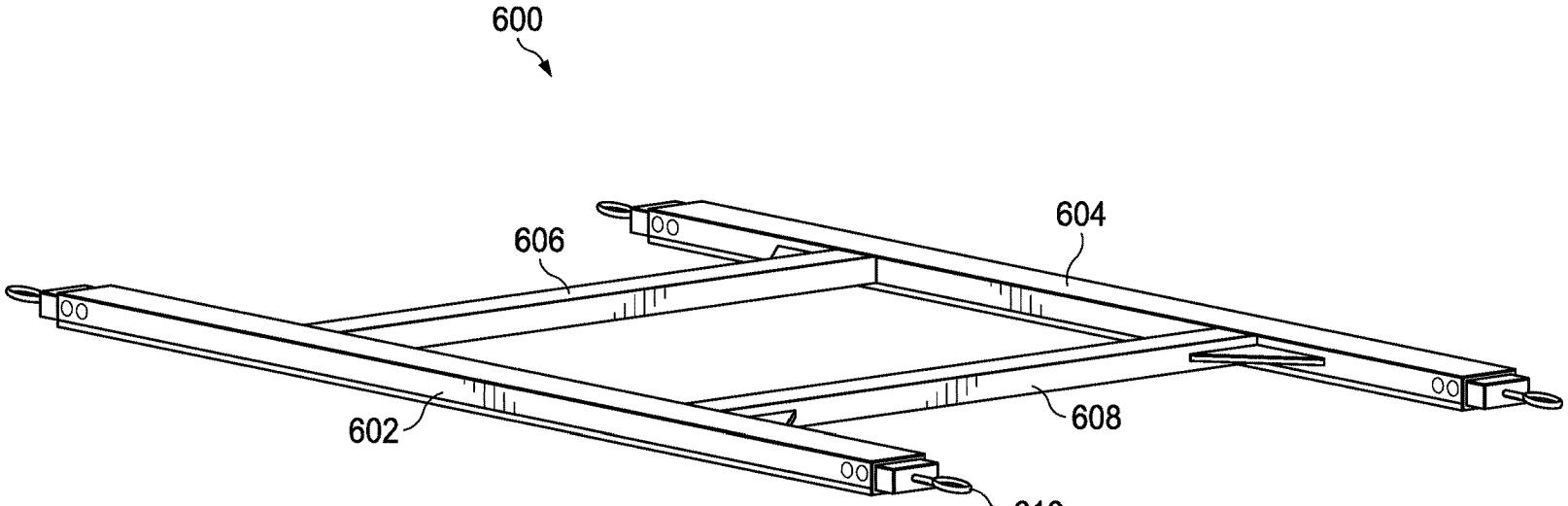
FIG. 6 is an illustration of a perspective view of an upper frame assembly for a lifting apparatus in accordance with an illustrative embodiment.

Turning to FIG. 6, an illustration of a perspective view of an upper frame assembly for a lifting apparatus is depicted in accordance with an illustrative embodiment. Upper frame assembly 600 may be an example of one implementation of upper frame assembly 104 in FIG. 1.

Upper frame assembly 600 may comprise upper frame bar 602 and upper frame bar 604. Upper frame bar 602 may be referred to as a first upper frame bar. Upper frame bar 604 may be referred to as a second upper frame bar. Upper frame bar 602 and upper frame bar 604 may be substantially parallel in upper frame assembly 600. Upper frame bar 602 and upper frame bar 604 may be connected to each other by cross piece 606 and cross piece 608. Cross piece 606 and cross piece 608 may be substantially parallel in upper frame assembly 600.

Attachment structure 610 may be provided at each end of upper frame bar 602 and upper frame bar 604 to provide a slidable connection to straps, such as straps 112 and straps 114 shown in block form in FIG. 1. For example, without limitation, attachment structure 610 may comprise an eye bolt that is mounted in an eye bolt insert that is inserted into each end of upper frame bar 602 and upper frame bar 604.

Figure 7:
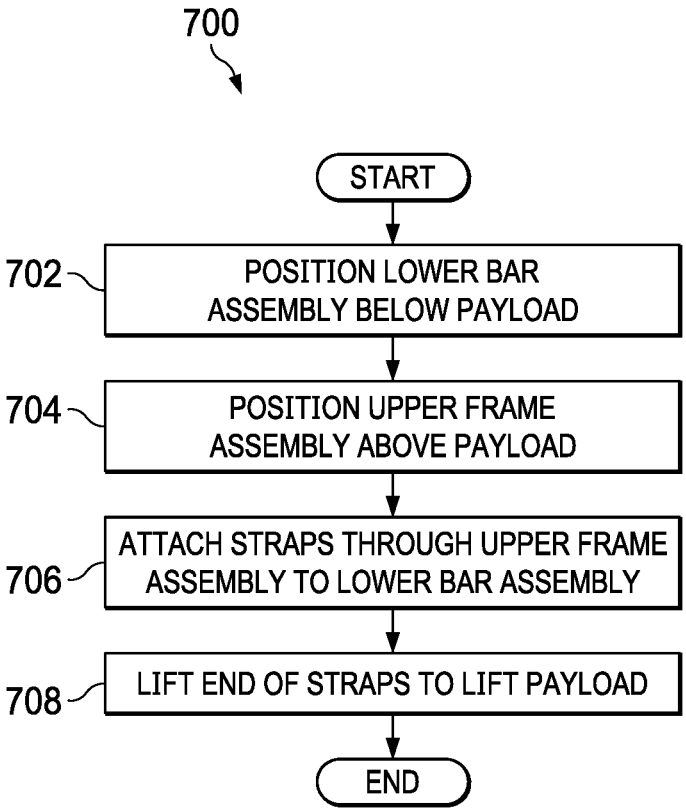
FIG. 7 is an illustration of a flowchart diagram of a method of lifting a payload in accordance with an illustrative embodiment.

Turning to FIG. 7, an illustration of a flowchart diagram of a method of lifting a payload is depicted in accordance with an illustrative embodiment. For example, without limitation, method 700 may be performed using lifting apparatus 100 in FIG. 1.

Method 700 may begin by positioning the lower bar assembly of the lifting apparatus below a payload to be lifted (operation 702). The upper frame assembly of the lifting apparatus then may be positioned above the payload (operation 704). Straps then may be slidably attached to the upper frame assembly and fixedly attached to the lower bar assembly (operation 706). The straps then may be lifted to lift the payload (operation 708), with the process terminating thereafter.

The flowcharts and block diagrams described herein illustrate the architecture, functionality, and operation of possible implementations of systems and methods according to various illustrative embodiments. It should be noted that the functions noted in a block may occur out of the order noted in the figures. For example, the functions of two blocks shown in succession may be performed substantially concurrently, or the functions of the blocks may sometimes be performed in the reverse order, depending upon the functionality involved. Furthermore, in some alternative implementations, the functions associated with some blocks in the flowcharts and block diagrams may be eliminated.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other desirable embodiments. The embodiment or embodiments selected are chosen and described in order to best explain the principles of the embodiments and the practical application of such principles, and enable others of ordinary skill in the art to understand the disclosure for various embodiments with various modifications as may be suited to various uses and applications.

What is claimed is:

1. A lifting apparatus, comprising:

a lower bar assembly;

an upper frame assembly, wherein the upper frame assembly comprises:

a first upper frame bar, wherein the first upper frame bar comprises a first attachment structure and a second attachment structure, wherein a first strap runs through the first attachment structure and is slidably attached to the upper frame assembly and a second strap runs through the second attachment structure and is slidably attached to the upper frame assembly, wherein the first and second strap are both fixedly attached to the lower bar assembly, and a second upper frame bar, wherein the second upper frame bar comprises a third attachment structure and a fourth attachment structure, wherein a third strap runs through the third attachment structure and is slidably attached to the upper frame assembly and a fourth strap runs through the fourth attachment structure and is slidably attached to the upper frame assembly, wherein the third and fourth strap are both fixedly attached to the lower bar assembly.

2. The lifting apparatus of claim 1, wherein the lower bar assembly comprises a first lower bar and a second lower bar.

3. The lifting apparatus of claim 1 further comprising padding on the lower bar assembly.

4. The lifting apparatus of claim 1, wherein the upper frame assembly comprises:

the second upper frame bar substantially parallel to the first upper frame bar; and a cross piece connects the first upper frame bar to the second upper frame bar and the cross piece is substantially perpendicular to the first upper frame bar and the second upper frame bar.

5. The lifting apparatus of claim 1 further comprising a stop on each strap configured to prevent each strap from becoming disconnected from the upper frame assembly.

6. The lifting apparatus of claim 1 further comprising a payload between the lower bar assembly and the upper frame assembly.

7. The lifting apparatus of claim 6, wherein the payload comprises an aircraft component.

8. A lifting apparatus, comprising:

a lower bar assembly comprising a first lower bar and a second lower bar;

an upper frame assembly comprising a first upper frame bar, a second upper frame bar substantially parallel to the first upper frame bar, and a cross piece connecting the first upper frame bar to the second upper frame bar and substantially perpendicular to the first upper frame bar and the second upper frame bar;

wherein the first upper frame bar comprises a first attachment structure and a second attachment structure, wherein a first strap runs through the first attachment structure and is slidably attached to the upper frame assembly and a second strap runs through the second attachment structure and is slidably attached to the upper frame assembly, wherein the first and second strap are both fixedly attached to the lower bar assembly; and wherein the second upper frame bar comprises a third attachment structure and a fourth attachment structure, wherein a third strap runs through the third attachment structure and is slidably attached to the upper frame assembly and a fourth strap runs through the fourth attachment structure and is slidably attached to the upper frame assembly, wherein both the third and fourth strap are both fixedly attached to the lower bar assembly.

9. The lifting apparatus of claim 8 further comprising padding on the lower bar assembly.

10. The lifting apparatus of claim 8 further comprising a stop on each strap configured to prevent each strap from becoming disconnected from the upper frame assembly.

11. The lifting apparatus of claim 8 further comprising a payload between the lower bar assembly and the upper frame assembly.

12. The lifting apparatus of claim 11, wherein the payload comprises an aircraft component.

13. A method of lifting a payload, comprising:

placing a lower bar assembly under the payload;

placing an upper frame assembly over the payload, wherein the upper frame assembly comprises a first upper frame bar and a second upper frame bar, wherein the first upper frame bar comprises a first attachment structure and a second attachment structure, wherein a first strap runs through the first attachment structure and is slidably attached to the upper frame assembly and a second strap slidably runs through the second attachment structure and is slidably attached to the upper frame assembly, wherein the second upper frame bar comprises a third attachment structure and a fourth attachment structure, wherein a third strap runs through the third attachment structure and is slidably attached to the upper frame assembly and a fourth strap runs through the fourth attachment structure and is slidably attached to the upper frame assembly;

fixedly attaching each strap to the lower bar assembly; and pulling upward on each strap to hold the payload between the lower bar assembly and the upper frame assembly and lift the payload.

14. The method of claim 13, wherein the lower bar assembly comprises a first lower bar and a second lower bar.

15. The method of claim 14 further comprising padding on the first lower bar between the first lower bar and the payload and padding on the second lower bar between the second lower bar and the payload.

16. The method of claim 13, wherein the upper frame assembly comprises:

the second upper frame bar substantially parallel to the first upper frame bar; and a cross piece connecting the first upper frame bar to the second upper frame bar and substantially perpendicular to the first upper frame bar and the second upper frame bar.

17. The method of claim 13 further comprising a stop on each strap configured to prevent each strap from becoming disconnected from the upper frame assembly.

18. The method claim 13, wherein the payload comprises an aircraft component.

19. The method of claim 13, wherein pulling upward on the straps comprises pulling upward on the straps by a crane.

* * * * *